US009415283B2

(12) United States Patent
Skurow et al.

(10) Patent No.: US 9,415,283 B2
(45) Date of Patent: Aug. 16, 2016

(54) REMOTE CONTROLLED GOLF BALL EJECTION DEVICE

(71) Applicants: David Skurow, Orlando, FL (US); Allen Skurow, Orlando, FL (US)

(72) Inventors: David Skurow, Orlando, FL (US); Allen Skurow, Orlando, FL (US)

( * ) Notice: Subject to any disclaimer, the term of this patent is extended or adjusted under 35 U.S.C. 154(b) by 0 days.

(21) Appl. No.: 14/733,033

(22) Filed: Jun. 8, 2015

(65) Prior Publication Data

US 2015/0352418 A1 Dec. 10, 2015

Related U.S. Application Data

(60) Provisional application No. 62/009,637, filed on Jun. 9, 2014.

(51) Int. Cl.
*A63B 57/40* (2015.01)
*A63B 57/00* (2015.01)

(52) U.S. Cl.
CPC ..... *A63B 57/0062* (2013.01); *A63B 57/0056* (2013.01); *A63B 57/405* (2015.10)

(58) Field of Classification Search
CPC .... A63B 57/405; A63B 57/357; A63B 57/40; A63B 69/3676; A63B 2063/001; A63B 2225/50
USPC ..... 473/178, 177, 163, 182, 183, 191, 194
See application file for complete search history.

(56) References Cited

U.S. PATENT DOCUMENTS

| | | | | | |
|---|---|---|---|---|---|
| 3,310,312 | A * | 3/1967 | Peeples | A63B 57/405 | 124/81 |
| 3,467,378 | A * | 9/1969 | English | A63B 57/405 | 473/178 |
| 3,897,059 | A * | 7/1975 | McCulloch | A63B 57/405 | 473/178 |
| 5,018,730 | A * | 5/1991 | Iliuta | A63B 57/405 | 473/175 |
| 5,174,574 | A * | 12/1992 | Knox | A63B 63/007 | 273/127 C |
| 5,382,018 | A | 1/1995 | Browne | | |
| 5,480,142 | A * | 1/1996 | Ackerman | A63B 57/357 | 473/177 |
| 5,890,967 | A * | 4/1999 | Allen | A63B 57/405 | 473/178 |
| 8,025,584 | B2 * | 9/2011 | Foley | A63B 69/3676 | 473/178 |

* cited by examiner

*Primary Examiner* — Mark Graham
(74) *Attorney, Agent, or Firm* — Jason T. Daniel, Esq.; Daniel Law Offices, P.A.

(57) ABSTRACT

A remote controlled golf ball ejection device includes a generally cylindrical cup liner having an open top end, and a curved bottom end with an elongated hollow channel extending downward therefrom. A golf ball ejector is positioned at the bottom end of the channel and is in communication with a controller and a power source. A remote control unit is in wireless communication with the controller and operates the golf ball ejector.

11 Claims, 5 Drawing Sheets

REMOTE CONTROLLED GOLF BALL EJECTION DEVICE

CROSS-REFERENCE TO RELATED APPLICATIONS

This application claims the benefit of U.S. Application Ser. No. 62/009,637 filed on 9 Jun. 2014, the contents of which are incorporated herein by reference.

TECHNICAL FIELD

The present invention relates generally to the game of golf, and more particularly to a device for ejecting a golf ball from a hole on a golf course green.

BACKGROUND

The statements in this section merely provide background information related to the present disclosure and may not constitute prior art.

In recent years, the game of golf has seen a dramatic increase in popularity and continues to attract scores of new players each day. To meet this demand, manufactures are constantly working on improvements for items such as golf balls, golf clubs, golf bags, golf shoes and other such articles which are used during game play. However, one portion of the game which has received extremely limited attention involves the process of retrieving the golf ball from the hole located on the green.

There are several known golf ball retrieval devices which can aid a golfer in retrieving the ball from the hole. The most common of these devices is typically secured onto the end of a putter, and allows the user to retrieve the ball without having to bend. Although useful in some regard, many golfers dislike these devices as their presence on the golf club can be a distraction during play, and because the weight of the device can alter the natural putting motion of the golfer.

Accordingly, it would be beneficial to provide a remote controlled device for ejecting a golf ball from a golf course hole which can be operated by a user, and that does not suffer from the drawbacks of the above noted devices.

SUMMARY OF THE INVENTION

The present invention is directed to a remote controlled golf ball ejection device. One embodiment of the present invention can include a generally cylindrical cup liner having an open top end and a curved bottom surface. An elongated channel extends downward from the curved bottom surface, and a golf ball ejector, power source and controller are located beneath the cup liner. The golf ball ejector includes an elongated rod having a distal tip which traverses the elongated channel. The elongated channel also functions to receive and position a golf pin and flag.

Another embodiment of the present invention can include a remote control unit which can communicate wirelessly with the controller. The curved bottom surface of the cup liner positions a golf ball at the top end of the elongated channel. When activated by a user, the remote control unit activates the golf ball ejector, and cause the same to vertically eject the golf ball to a predetermined height above the top end of the cup liner.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
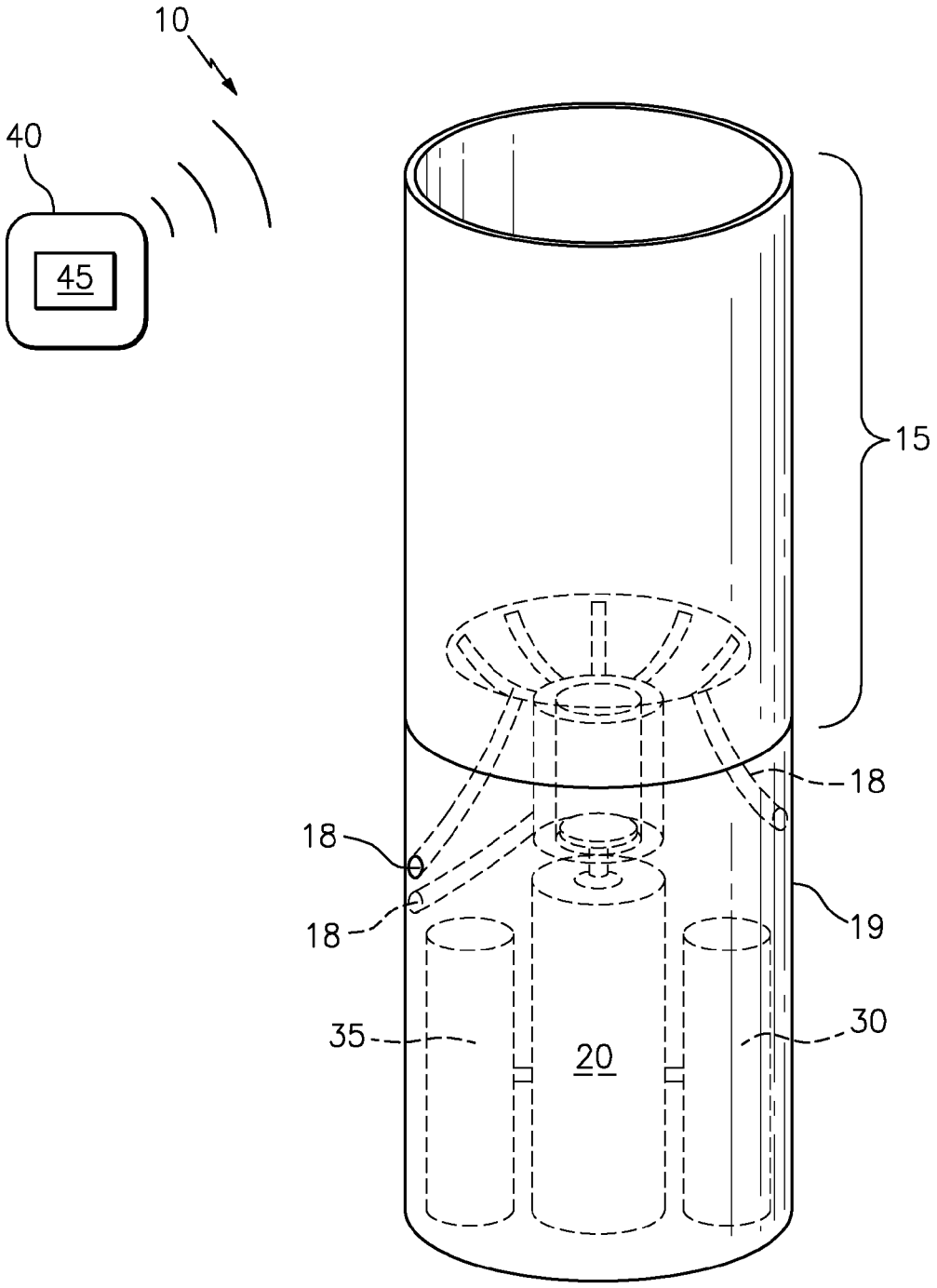
FIG. 1 is a perspective view of a remote controlled golf ball ejection device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

The presently claimed invention contemplates a remote controlled device for ejecting a golf ball from a golf course hole. As will be described below in detail, the device can be constructed from any number of different materials and can be used for many different purposes. In this regard, the below descriptions and illustrations are to provide but one means for performing the inventive concepts and are not to be construed as limiting in any way.

Figure 2:
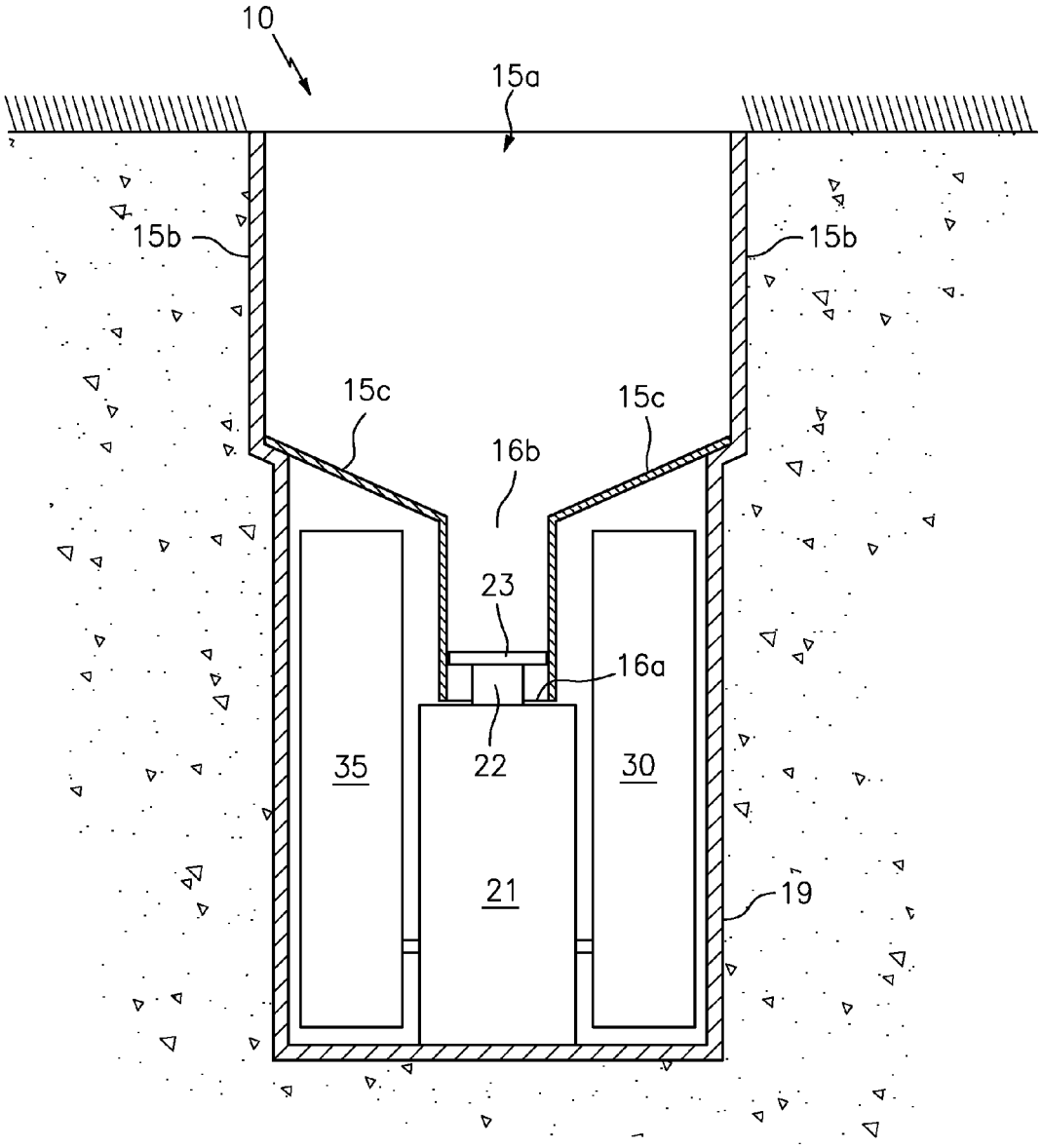
FIG. 2 is a partial cutout side view of the remote controlled golf ball ejection device, in accordance with one embodiment of the invention.
Figure 3:
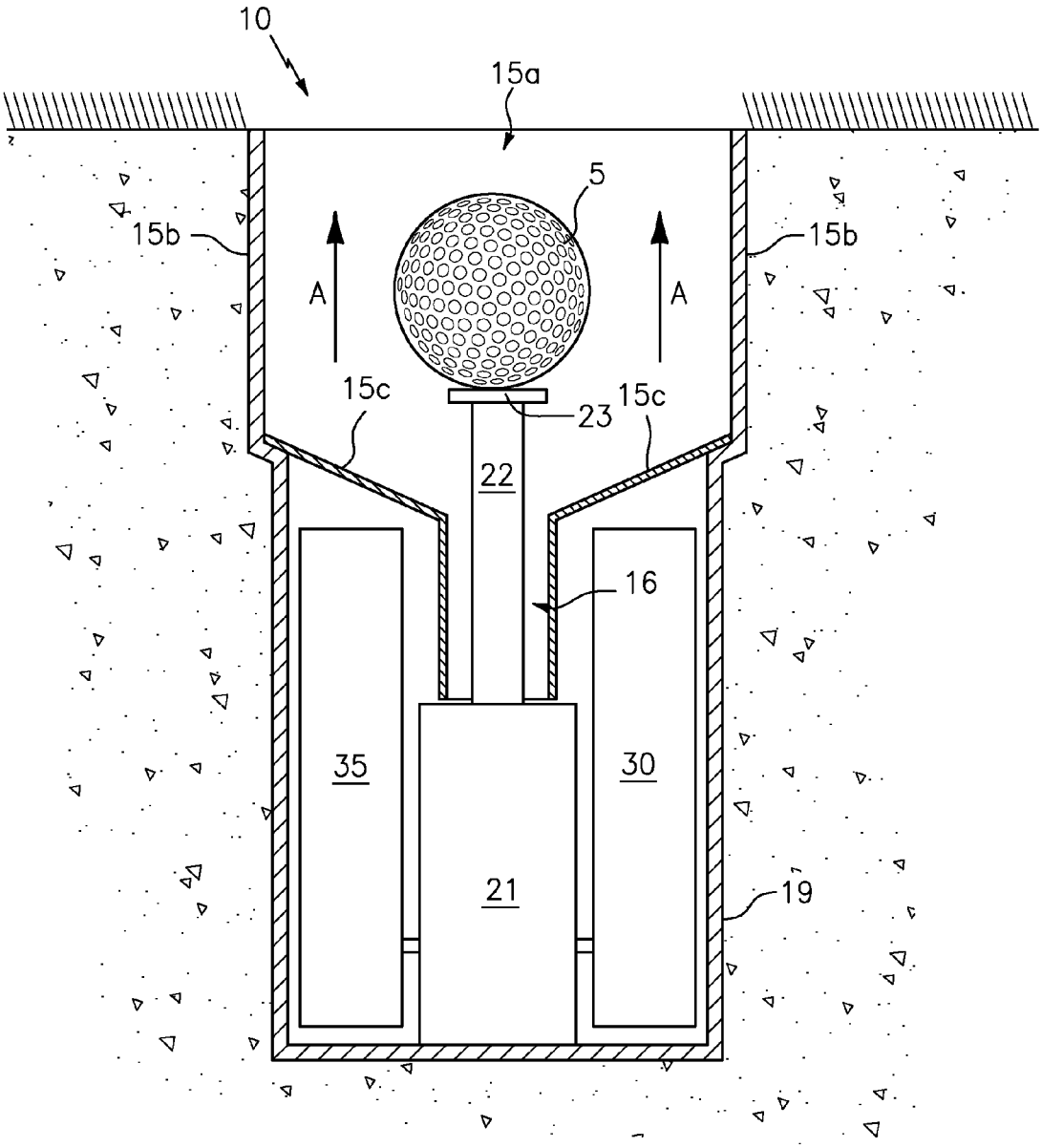
FIG. 3 is another partial cutout side view of the remote controlled golf ball ejection device, in accordance with one embodiment of the invention.

FIGS. 1-3 illustrate one embodiment of a remote controlled golf ball ejection device 10, that is useful for understanding the inventive concepts disclosed herein. As shown, the device can include, essentially, a hole liner 15, a golf ball ejector 20, a controller 30, a power source 35, and a remote control unit 40. Although the device will be described and illustrated with particular components at specific locations, this is for illustrative purposes only, as each of the below described components can include any number of different shapes, sizes, dimensions and orientation to each other.

The upper section of the device 10 can comprise the hole liner 15 that functions to receive a golf ball and a flag. In the preferred embodiment, the hole liner 15 can include an elongated, generally cylindrical member having an open top end 15*a*, a generally circular middle section 15*b* and an angled bottom section 15*c* terminating into an elongated generally hollow channel 16. In one embodiment, a series of apertures 18 can be disposed along the hole liner in order to prevent moisture such as rainwater from accumulating therein. As shown, each of the apertures can form a channel for directing water into the surrounding ground. In the preferred embodiment, the hole liner 15 can be constructed from a sturdy material such as hard plastic, for example; however, any number of other materials that are suitable for prolonged exposure to the elements are also contemplated.

Although dimensions are not critical, the hole liner 15 can preferably include an inside diameter of approximately 4.25 inches, and a depth (measured from the top end 15*a* to the bottom end 15*b*) of between approximately 4.5 and 6 inches, for example. Such dimensions being in conformity with USGA regulations. Likewise, the hollow channel 16 can preferably include a diameter of between approximately ¼ and ¾ inches, so as to receive the pin of a standard golf course flag (not illustrated), and to position the same upright. Of course, any number of other shapes, and sizes are also contemplated, so as to facilitate use in other sports and/or to accommodate rule changes in golf.

A lower body 19 can function to house each of the ejector 20, power source 30 and controller 35. In this regard, the lower body can preferably be constructed from a rigid, waterproof material such as hardened plastic, for example. The lower body can be constructed as an integral component with the hole liner 15, or can be positioned as a separate component that is mated with the bottom of the hole liner, in accordance with known construction methodologies. In either instance, the lower body can preferably include a generally cylindrical shape so as to allow the entire device 10 to be positioned within a standard sized 4.25 inch hole created on a golf course green via an auger, or other such device. However, other shapes and sizes are contemplated.

The golf ball ejector 20 can function to eject a golf ball from the liner 15 at a controlled velocity upon receiving an instruction from the remote control unit 40 (described below). As shown in FIGS. 2 and 3 wherein a portion of the liner 15 and outer body 19 are removed for ease of illustration, the golf ball ejector can include an electrically powered linear actuator 21, having an internal motor that moves an elongated rod 22 and a broad tip member 23. As shown, the piston rod 22 and the tip 23 can be located within the channel 16 and can transition between a retracted state (FIG. 2) and an extended state (FIG. 3).

When in the retracted state, the majority of the piston rod 22 is located within the linear actuator body and the tip 23 is positioned adjacent to the lower end of the channel 16*a*. At this time, the channel is unobstructed, and functions to receive and position the flag pin 2 above the device.

Figure 5:
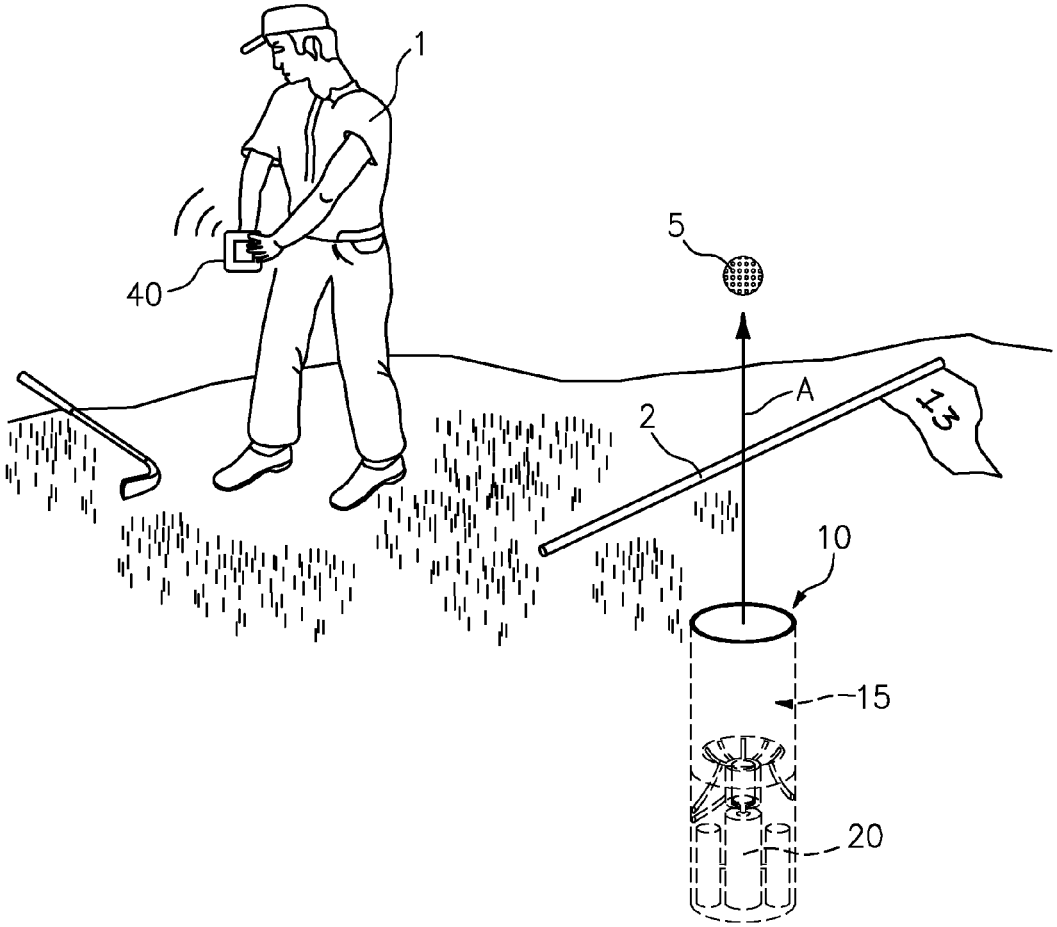
FIG. 5 is a perspective view of the remote controlled golf ball ejection device in operation, and in accordance with one embodiment of the invention.

Once the flag pin has been removed, and when activated by the below described remote control unit 40, the actuator 21 can rapidly extend the rod 22 and tip 23 towards/through the upper end of the channel 16*b*, so as to engage a golf ball 5 located at the bottom of the hole liner 15. Owing to the curved bottom end of the liner, the ball 5 will be positioned at the upper end of the channel 16*b* and can be propelled upwards A at any number of different speeds and/or velocities. As shown in FIG. 5, the ejector 20 can eject the ball 5 vertically to any desirable height A, so as to allow a user 1 to easily catch the discharged golf ball in the air.

Although the speed and velocity of the actuator movement is not critical, in one preferred embodiment, the actuator can move the rod 22 and tip 23 upwards at a speed of between approximately 5 and 12 miles per hour, so as to impart a force that is sufficient to gently propel the golf ball upwards to a height of between approximately 3 and 5 feet from the top of the liner. Of course, any number of other speeds and/or forces are also contemplated so as to allow a golf ball to be ejected to a height that is greater or less than that described above. In some instances, the speed and/or force can be adjusted by a user (such as a golf course staff, for example) so as to adjust for environmental factors such as altitude and humidity, for example.

Although described above as utilizing an electrically powered linear actuator, this is but one possible means for engaging the golf ball and ejecting the same from the hole. As such, the invention is not to be construed as limiting in this regard, as the golf ball ejector 20 can include any number of other known devices capable of launching a golf ball vertically from the liner to a predetermined height.

Figure 4:
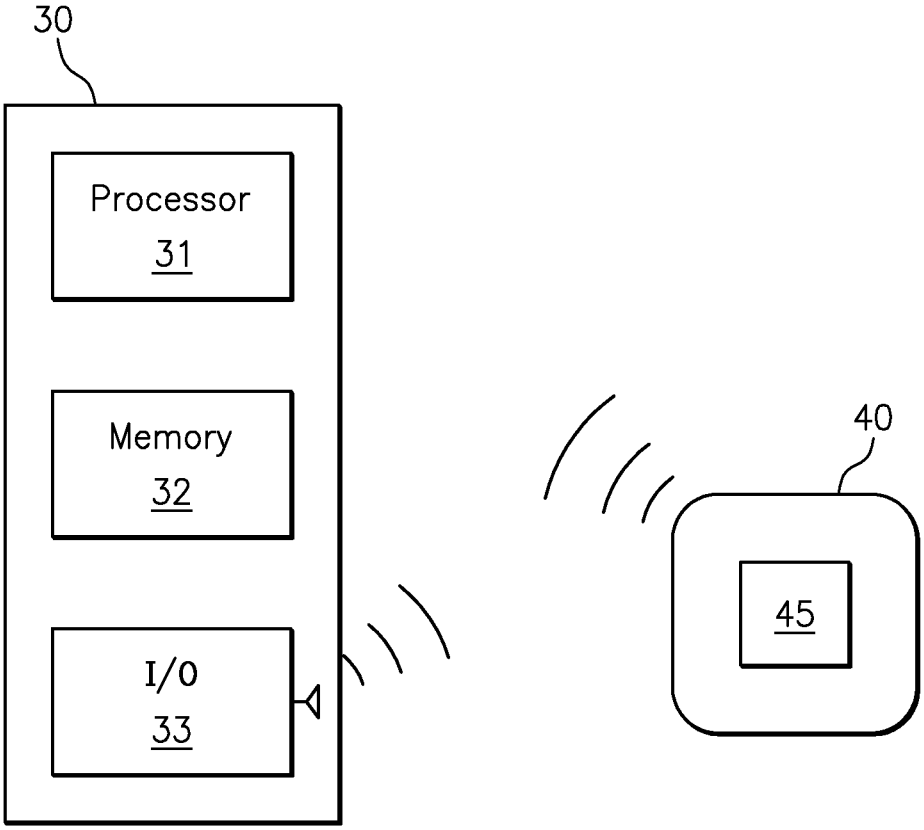
FIG. 4 is a simplified block diagram of the controller and remote control unit of the remote controlled golf ball ejection device, in accordance with one embodiment of the invention.

FIG. 4 is a simplistic block diagram illustrating one embodiment of a controller 30. In one embodiment, the controller 30 can include a processor 31 that is conventionally connected to an internal memory 32, an input/output unit 33, and the power source 35.

Although illustrated as separate elements, those of skill in the art will recognize that one or more system components 30 may be, or include one or more printed circuit boards (PCB) containing an integrated circuit or circuits for completing the activities described herein. The CPU may be one or more integrated circuits having firmware for causing the circuitry to complete the activities described herein. Moreover, other embodiments are contemplated wherein one or more of the above components are omitted.

The processor/CPU 31 can act to execute program code stored in the memory 32 in order to allow the device to perform the functionality described herein. Processors are extremely well known in the art, therefore no further description will be provided.

Memory 32 can act to store operating instructions in the form of program code for the processor 31 to execute. Although illustrated in FIG. 3 as a single component, memory 32 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 32 can also include one or more cache memories that provide temporary storage of at least some program code in order to reduce the number of times program code must be retrieved from the bulk storage device during execution. Each of these devices is well known in the art.

The input/output unit 33 can function to accept user inputs and provide instructions to the processor. In one preferred embodiment, the input/output unit can comprise a wireless communication unit that can send and/or receive a signal with a remote control unit 40. For example, the unit can include a variable radio wave receiver having a unique radio frequency chip capable of receiving and translating a plurality of independent radio frequencies which can be sent to the processor 31 and/or the memory 32.

In this regard, when the device 10 is operational on a golf course, each group or player can be issued a remote control unit 40 having a button 45 for activating an internal transmitter. As such, whenever the remote control unit 40 is within range of the device 10 (e.g., typically less than 10 feet), a user can press the button 45 which can send a wireless signal to the receiver. Upon receiving the signal, the processor can instruct the ball ejector 20 to activate, thereby ejecting the ball 5, as described above.

Although described above as using radio transmission, reception, in conjunction with a specific remote control unit, many other communication mediums and associated components can also be utilized in conjunction with, or in place of the above described components. Several nonlimiting communication mechanisms including, for example, infrared (IR), Bluetooth and/or RFID.

To this end, in an alternate embodiment, the input/output unit 33 can include a Bluetooth transceiver which can operate in conjunction with an App that can be downloaded and installed on a user's smartphone, golfing GPS and/or golfing rangefinder, for example. Such a feature can allow the user to operate the device 10 during play, without the need for a dedicated remote control unit 40.

In the preferred embodiment, the device 10 can include one or more batteries 30 which can function to supply the necessary power requirements to the ball ejector 20 and/or the controller 30. The batteries can preferably be located within the lower body 19, and can be accessible via a battery compartment (not illustrated) or through a charging port such as a mini or micro USB port, for example. Of course, the device can also include any number of externally located batteries, and/or can be configured to operate utilizing AC power, in the event that underground electric facilities are available.

Accordingly, the above described remote controlled golf ball ejector device 10 can function as a novel means for retrieving golf balls from within the hole liner on a golf course green after a successful golf stroke.

As described herein, one or more elements of the remote controlled golf ball ejector device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the cup liner 15 and the lower body 19, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A remote controlled golf ball ejection device, said device comprising:

a generally cylindrical cup liner having an open top end, and a curved bottom end;

an elongated hollow channel having an upper end that is positioned along a center of the curved bottom end of the cylindrical cup;

a golf ball ejector that is in communication with the elongated hollow channel, said ejector functioning to eject a golf ball vertically from the curved bottom end of the cup liner to a first height;

a controller that is in communication with the golf ball ejector, said controller including a memory, a wireless communication unit, and a processor that is in communication with each of the memory and the wireless communication unit;

a power source that is in communication with each of the controller and the golf ball ejector; and a remote control unit that functions to communicate wirelessly with the controller, wherein the wireless communication unit is configured to communicate with the remote control unit using, at least one of a unique radio frequency, infrared, and a Bluetooth signal.

2. The device of claim 1, wherein the golf ball ejector comprises:

a linear actuator having a telescoping rod and a tip member along a distal end.

3. The device of claim 2, wherein the rod and tip member include a shape and size that is suitable for moving within the elongated hollow channel.

4. The device of claim 3, wherein the rod and tip member are located adjacent to a bottom end of the elongated hollow channel when the device is in a retracted state.

5. The device of claim 3, wherein the rod and tip member are located adjacent to a top end of the elongated hollow channel when the device is in an extended state.

6. The device of claim 1, further comprising:

a plurality of apertures that are disposed along the cylindrical cup liner, said apertures functioning to remove water from an inside surface of the cylindrical cup liner.

7. The device of claim 1, further comprising:

a plurality of apertures that are disposed along the elongated hollow channel, said apertures functioning to remove water from an inside surface of the channel.

8. The device of claim 1, wherein the elongated hollow channel includes a shape and dimension that is suitable for receiving and positioning a golf pin and flag in a vertical orientation.

9. The device of claim 1, wherein the cylindrical cup liner includes an inside diameter of approximately 4.25 inches.

10. The device of claim 1, further comprising:

a waterproof lower body that is in communication with the cylindrical cup liner, and including a generally hollow portion for positioning each of the golf ball ejector, the controller and the power source.

11. The device of claim 1, wherein said first height is between approximately 3 and 5 feet from the open top end of the cup liner.

* * * * *